US006746313B1

(12) United States Patent
Pham et al.

(10) Patent No.: US 6,746,313 B1
(45) Date of Patent: Jun. 8, 2004

(54) POLISHING HEAD ASSEMBLY IN AN APPARATUS FOR CHEMICAL MECHANICAL PLANARIZATION

(75) Inventors: Xuyen Pham, Fremont, CA (US); Anthony de la Llera, Union City, CA (US)

(73) Assignee: Lam Research Corporation, Fremont, CA (US)

( * ) Notice: Subject to any disclaimer, the term of this patent is extended or adjusted under 35 U.S.C. 154(b) by 428 days.

(21) Appl. No.: 09/999,066

(22) Filed: Oct. 24, 2001

(51) Int. Cl.[7] ..... B24B 1/00

(52) U.S. Cl. ..... 451/41; 451/285; 451/286; 451/287; 451/288; 451/289; 451/397; 451/398

(58) Field of Search ..... 451/41, 285, 286, 451/287, 288, 289, 397, 398

(56) References Cited

U.S. PATENT DOCUMENTS 5,722,877 A 3/1998 Meyer et al.
5,762,544 A 6/1998 Zuniga et al.
5,769,696 A 6/1998 Lee et al.
5,820,448 A 10/1998 Shamouilian et al.
5,993,302 A 11/1999 Chen et al.
6,244,946 B1 * 6/2001 Volodarsky ..... 451/307
6,309,290 B1 10/2001 Wang et al.
6,527,624 B1 * 3/2003 Tolles et al. ..... 451/41

* cited by examiner

*Primary Examiner*—Joseph J. Hail, III
*Assistant Examiner*—Shantese McDonald
(74) *Attorney, Agent, or Firm*—Brinks Hofer Gilson & Lione

(57) ABSTRACT

A polishing head assembly for use in a chemical mechanical planarization apparatus is provided. The polishing head assembly includes a carrier head shaped substantially like a disk having a circumference, a top surface, a bottom surface, and an outer wall, the outer wall having a groove therein, the groove extending into the carrier head from the bottom surface of the carrier head, and the groove running the entire circumference of the carrier head; and a retainer ring having an interior wall and an exterior wall, the interior wall of the retainer ring being in contact with the outer wall of the carrier head, the interior wall having a slot therein, the slot defining a lower portion of the interior wall as a flexible leg, the flexible leg having a receiving end that is adapted to secure an object having a surface to be polished, the slot having a first terminal end adjacent to the groove in the carrier head and a second terminal end, opposite the first terminal end, in the body of the retainer ring. A carrier head is provided, as is a retainer ring. A method of compensating for uneven force distribution in a chemical mechanical planarization apparatus is also provided.

19 Claims, 2 Drawing Sheets

POLISHING HEAD ASSEMBLY IN AN APPARATUS FOR CHEMICAL MECHANICAL PLANARIZATION

FIELD OF THE INVENTION

The present invention relates to a polishing head assembly for use in an apparatus for the chemical mechanical planarization (CMP) of surfaces such as semiconductor wafers.

BACKGROUND

CMP is used to planarize raw semiconductor wafers and each layer of material added to the semiconductor wafer thereafter. Conventional CMP systems often use a rotating wafer holder that brings the semiconductor wafer into contact with a polishing pad. The polishing pad moves in the plane of the semiconductor wafer surface to be polished. A polishing fluid, such as a chemical polishing agent or slurry containing microabrasives, is applied to the polishing pad. The wafer holder then presses the semiconductor wafer against the rotating polishing pad, and polishing commences.

During polishing, a semiconductor wafer is held by a polishing head apparatus. The semiconductor wafer is shaped like a disk, having a surface to be polished, a backside opposite that side, and outer perimeter. The backside of the semiconductor wafer is held against a carrier head through vacuum ports, and the outer perimeter of the semiconductor wafer is held with a retainer ring.

During polishing, a spindle rotates the semiconductor wafer as the spindle applies a downward force on the carrier head, pushing the semiconductor wafer against the polishing pad. The spindle has a diameter that is smaller than the diameter of the carrier head. Thus, the force on the semiconductor wafer tends to be greater in the center than around its perimeter. This can cause the perimeter of the semiconductor wafer to flare up, away from the polishing pad while the center region is being pressed more forcefully against the pad. This uneven force distribution can also cause uneven polishing of the semiconductor wafer.

Methods and apparatuses are needed to compensate for the uneven force distribution in existing CMP systems.

SUMMARY OF THE INVENTION

The present invention solves at least some of the problems left unsolved by existing carrier heads, retainer rings, and CMP apparatuses.

In one aspect of the invention, a polishing head assembly for use in a chemical mechanical planarization apparatus is provided. The polishing head assembly comprises (a) a carrier head shaped substantially like a disk having a circumference, a top surface, a bottom surface, and an outer wall, the outer wall having a groove therein, the groove extending into the carrier head from the bottom surface of the carrier head, and the groove running the entire circumference of the carrier head; and (b) a retainer ring having an interior wall and an exterior wall, the interior wall of the retainer ring being in contact with the outer wall of the carrier head, the interior wall having a slot therein, the slot defining a lower portion of the interior wall as a flexible leg, the flexible leg having a receiving end that is adapted to secure an object having a surface to be polished, the slot having a first terminal end adjacent to the groove in the carrier head and a second terminal end, opposite the first terminal end, in the body of the retainer ring.

In another aspect of the invention, a carrier head for use in a polishing head assembly is provided. The carrier head is shaped substantially like a disk having a circumference, a top surface, a bottom surface, and an outer wall, the outer wall having a groove therein, the groove extending into the carrier head from the bottom surface of the carrier head, and the groove running the entire circumference of the carrier head.

In still another aspect of the invention, a retainer ring for use in a polishing head assembly is provided. The retainer ring has an exterior wall and interior wall, the interior wall of the retainer ring having a slot therein, the slot defining an upper portion of the interior wall adapted to grip a carrier head and a lower portion of the interior wall as a flexible leg, the flexible leg having a receiving end that is adapted to secure an object having a surface to be polished, the slot having a first terminal end adjacent to the groove in the carrier head and a second terminal end, opposite the first terminal end, in the body of the retainer ring.

In yet another aspect of the invention, a method of compensating for uneven force distribution in a chemical mechanical planarization apparatus is provided. The method comprises (a) providing a chemical mechanical planarization apparatus having a head retainer, a carrier head in the retainer, and a retainer ring around the carrier head wherein a downward force is applied more forcefully in a central region of carrier head than in a perimeter region of the carrier head; (b) making a groove in the carrier head around the perimeter of the carrier head; (c) making a slot in the retainer ring that divides the retainer ring into an upper portion in contact with the carrier head and a lower portion that is a flexible leg having a receiving end that is adapted to receive an outer perimeter of a semiconductor wafer, the slot having a terminal end adjacent to the groove; and (d) securing a wafer against the carrier head such that the receiving end of the flexible leg grips semiconductor wafer and can move the outer perimeter of the semiconductor wafer to compensate for the uneven force distribution of the chemical mechanical planarization apparatus.

The present invention provides the foregoing and other features, and the advantages of the invention will become further apparent from the following detailed description of the presently preferred embodiments, read in conjunction with the accompanying drawings. The detailed description and drawings are merely illustrative of the invention and do not limit the scope of the invention, which is defined by the appended claims and equivalents thereof.

DETAILED DESCRIPTION OF THE PREFERRED EMBODIMENTS

Figure 1:
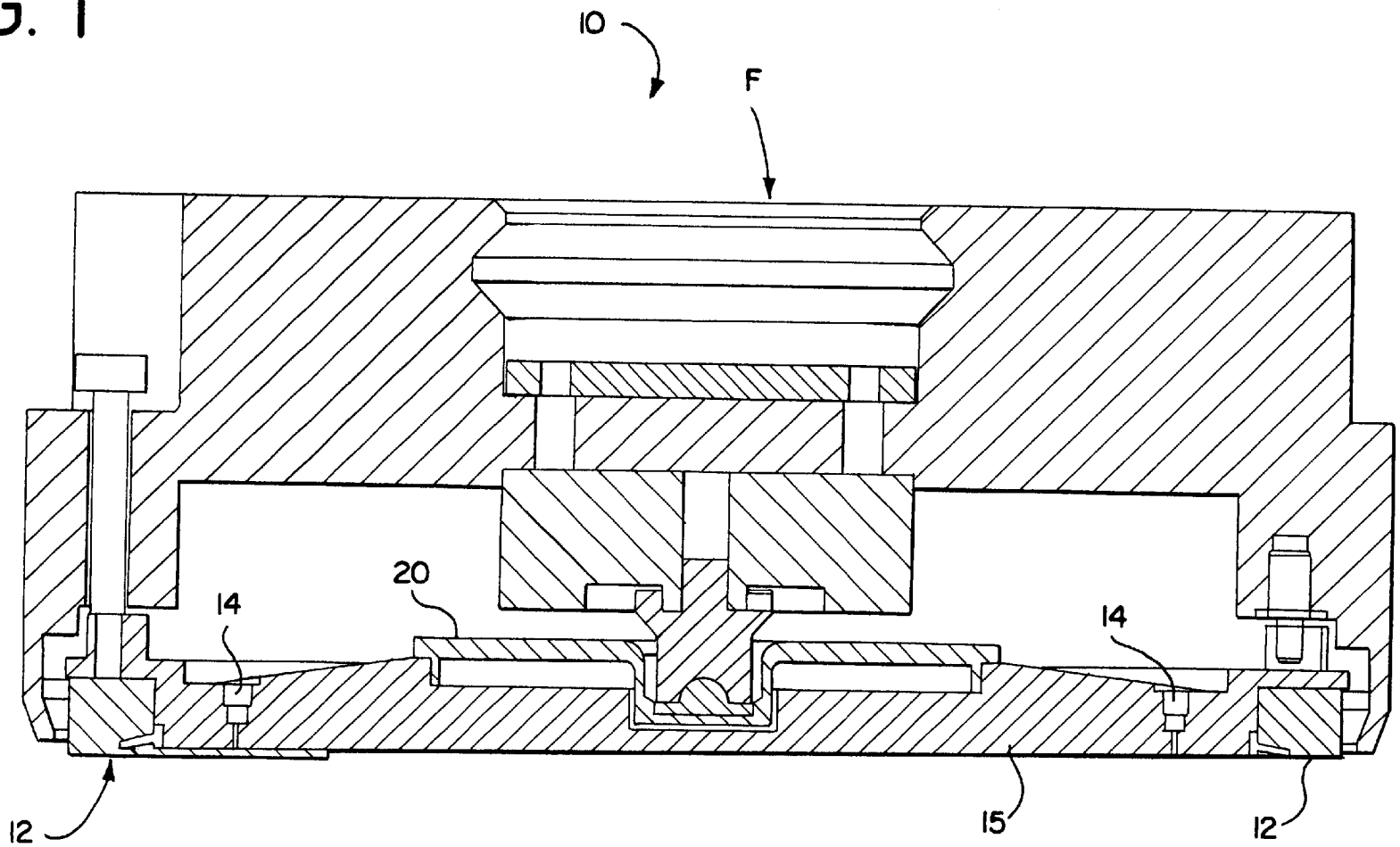
FIG. 1 shows a preferred embodiment of a polishing head assembly.
Figure 2:
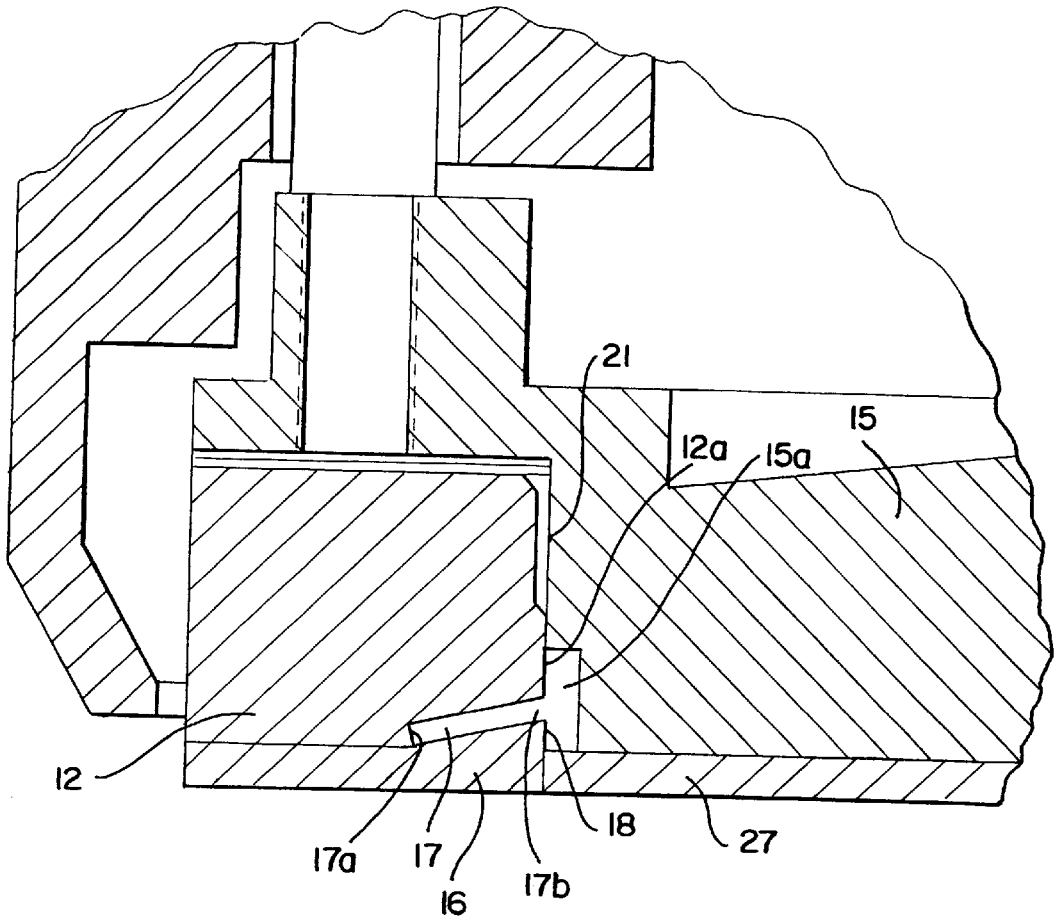
FIG. 2 shows a blow-up of the polishing head assembly of FIG. 1.

Referring to FIGS. 1 and 2, a polishing head assembly 10 is shown. The polishing head assembly 10 can be used with any CMP apparatus including linear polishing systems such as the TERES CMP system, available from Lam Research Corporation of Fremont, Calif.; rotary polishing systems such as the MIRRA CMP system, available from Applied Materials of Santa Clara, Calif.; and other suitable CMP systems known to those who are skilled in the art. The polishing head assembly 10 can be used to polish semiconductor wafers as well as silicon-on-insulator (SOI) surfaces, silicon-on-sapphire (SOS) surfaces and other surfaces that are fabricated on non-conductive carriers.

In the polishing head assembly 10, a force F is applied to the polishing head assembly 10 to push the object to be polished against the polishing pad P. A load distribution plate 20 helps distribute the downward force F more evenly across the entire carrier head 15 so that the semiconductor wafers or other objects to be polished can be polished uniformly.

During polishing, a retainer ring 12 surrounds a carrier head 15, both of which secure objects to be polished in place, in conjunction with vacuum and air ports 14. Although the retainer ring 12 is shown in FIG. 1 to be aligned vertically, retainer ring 12 can optionally be angled from the vertical axis in a direction away from the center of the carrier head 15. The angle can range from about 0 degrees to about 15 degrees, preferably about 6 degrees.

The retainer ring 12 can be a modified version of any type of retainer ring known to one of skill in the art. Preferably, the retainer ring 12 is a modified version of the retainer ring described in U.S. Pat. No. 5,722,877, issued to Lam Research Corp., which is hereby incorporated by reference. The retainer ring 12 is modified so that an interior wall 12*a* that has a slot 17 therein, the slot separating a flexible leg 16 from the rest of the interior wall 12*a*. The slot 17 can be built into the retainer ring 12 using any method known in the art of machining and molding.

Preferably, the slot 17 is of a uniform width of from about 0.01 inches wide to about 0.06 inches wide. Preferably, the slot 17 is of a uniform length (from terminal end 17*a* to terminal end 17*b*) of from about 0.04 long to about 0.40 inches long.

The slot 17 is in a plane that intersects with a horizontal plane the terminal end 17*a*. This intersection defines an angle above the line of intersection of from about 0 degrees to about 45 degrees, preferably from about 0 degrees to about 20 degrees.

The flexible leg 16 has a receiving end 18 that is adapted to secure an object having a surface to be polished. The receiving end 18 can be sized so that about half of the receiving end 18 is in contact with the object having a surface to be polished. Alternatively, the receiving end 18 can be sized so that less than half of the receiving end 18 is in contact with the object having a surface to be polished, or so that more than half of the receiving end 18 is in contact with the object having a surface to be polished.

The carrier head 15, which preferably is shaped substantially like a disk, can be a modified version of any type of carrier head known to one of skill in the art. For example, the carrier head 15 can be a modified version of one of the carrier heads described in U.S. Pat. Nos. 5,762,544, 5,820,448, and 5,993,302, which are hereby incorporated by reference. The carrier head 15 is modified so that the outer wall 21 of the carrier head 15 has a groove 15*a* of a uniform height and a uniform depth around the perimeter of a lower portion of the outer wall 21. The groove 15*a* can be built into the outer wall 21 using any method known in the art of machining and molding, including milling, and turning on a lathe and machining.

The groove 15*a* extends from the bottom of the outer wall 21 to a uniform height of from about 0.005 inches high to about 0.125 inches high, preferably from about 0.005 inches high to about 0.060 inches high. The groove 15*a* extends into the outer wall 21 to a uniform depth of from about 0.005 inches deep to about 0.100 inches deep, preferably from about 0.005 inches deep to about 0.050 inches deep.

Optionally, the carrier head 15 is lined with a carrier film 27. The purpose of carrier film 27 is to prevent the object to be polished from moving around during polishing. The carrier film 27 can be any standard film used in semiconductor manufacturing and processing that is suitable for contacting the object to be polished during polishing. Carrier films are typically made of polymeric material and commercially available from manufacturers of CMP auxiliary equipment, such as RODEL in Newark, Del. Preferably, the carrier film 27 is an oxide. The carrier film 27 may contain tungsten, copper, or aluminum.

The carrier film 27 is attached to the carrier head 15 by adhering the carrier film 27 to the surface of the carrier head 15 with an adhesive. Pressure sensitive adhesives are preferred. Once applied, the carrier film 27 can be laid to any desired thickness. Such carrier films and the process for attaching the carrier films to polishing heads are described in U.S. Pat. No. 5,769,696, which is hereby incorporated by reference in its entirety.

Referring to FIG. 2, the groove 15*a* intersects with the terminal end of the slot 17*b*. It is this intersection that permits the flexible leg 16 to be flexible. The portion of the receiving end 18 of the flexible leg 16 that is not in contact with an object to be polished does not endure friction because the portion of the receiving end 18 of the flexible leg 16 that is not in contact with an object to be polished is also not in contact with the carrier head 15. Because the flexible leg 16 is not held in place by friction, the flexible leg 16 can move upward and downward, depending upon the width of the slot 17.

The flexible leg 16 should be sufficiently flexible to compensate for an uneven distribution of force on an object to be polished in a CMP apparatus.

To adjust the flexibility of flexible leg 16, one of skill in the art can adjust the width of slot 17. Increasing the width increases the range of motion of the flexible leg 16 in the Z direction with respect to the horizontal plane. Decreasing the width of slot 17 has the opposite effect.

To adjust the flexibility of flexible leg 16, one of skill in the art can adjust the location of the slot 17 to increase or decrease the thickness of flexible leg 16. Generally, the thicker flexible leg 16, the less flexible, and the thinner, the more flexible.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is therefore indicated by the appended claims rather than by the foregoing description. All changes that come within the meaning and range of equivalency of the claims are embraced to be within their scope.

What is claimed is:

1. A polishing head assembly for use in a chemical mechanical planarization apparatus, the polishing head assembly comprising:

(a) a carrier head shaped substantially like a disk having a circumference, a top surface, a bottom surface, and an outer wall, the outer wall having a groove therein, the groove extending into the carrier head from the bottom surface of the carrier head, and the groove running the entire circumference of the carrier head; and (b) a retainer ring having an interior wall and an exterior wall, the interior wall of the retainer ring being in contact with the outer wall of the carrier head, the interior wall having a slot therein, the slot defining a lower portion of the interior wall as a flexible leg, the flexible leg having a receiving end that is adapted to secure an object having a surface to be polished, the slot having a first terminal end adjacent to the groove in the carrier head and a second terminal end, opposite the first terminal end, in the body of the retainer ring.

2. The polishing head assembly of claim 1 wherein the groove has a uniform height of from about 0.005 inches to about 0.125 inches.

3. The polishing head assembly of claim 1 wherein the groove has a uniform height of from about 0.005 inches to about 0.060 inches.

4. The polishing head assembly of claim 1 wherein the groove extends from the bottom surface of the carrier head into the carrier head to a uniform depth of from about 0.005 inches to about 0.100 inches.

5. The polishing head assembly of claim 1 wherein the groove extends from the bottom surface of the carrier head into the carrier head to a uniform depth of from about 0.005 inches to about 0.050 inches.

6. The polishing head assembly of claim 1 wherein the slot in the interior wall of the retainer rings is in a plane that intersects with a horizontal plane at the second terminal end of the slot, defining an angle above the line of intersection of from about 0 degrees to about 45 degrees.

7. The polishing head assembly of claim 1 wherein the slot in the interior wall of the retainer rings is in a plane that intersects with a horizontal plane at the second terminal end of the slot, defining an angle above the line of intersection of from about 0 degrees to about 20 degrees.

8. The polishing head assembly of claim 1 wherein more than half of the receiving end of the flexible leg is in contact with the object having a surface to be polished.

9. The polishing head assembly of claim 1 wherein about half of the receiving end of the flexible leg is in contact with the object having a surface to be polished.

10. The polishing head assembly of claim 1 wherein less than half of the receiving end of the flexible leg is in contact with the object having a surface to be polished.

11. The polishing head assembly of claim 1 wherein the carrier head further comprises a carrier film on the bottom surface.

12. The polishing head assembly of claim 11 wherein the carrier film comprises metal selected from the group consisting of tungsten, copper, and aluminum.

13. The polishing head assembly of claim 11 wherein the carrier film comprises a polymeric material.

14. The polishing head assembly of claim 1 wherein the object having a surface to be polished is a semiconductor wafer.

15. The polishing head assembly of claim 1 wherein the object having a surface to be polished is a silicon-on-insulator device.

16. The polishing head assembly of claim 1 where in the object having a surface to be polished is a silicon-on-sapphire device.

17. A chemical mechanical planarization apparatus comprising the polishing he ad assembly of claim 1.

18. A retainer ring for use in a polishing head assembly, the retainer ring having an exterior wall and interior wall, the interior wall of the retainer ring having a slot therein, the slot defining an upper portion of the interior wall adapted to grip a carrier head and a lower portion of the interior wall as a flexible leg, the flexible leg having a receiving end that is adapted to secure an object having a surface to be polished, the slot having a first terminal end adjacent to a groove in the carrier head and a second terminal end, opposite the first terminal end, in the body of the retainer ring.

19. A method of compensating for uneven force distribution in a chemical mechanical planarization apparatus, comprising:

(a) providing a chemical mechanical planarization apparatus having a head retainer, a carrier head in the retainer, and a retainer ring around the carrier head wherein a downward force is applied more forcefully in a central region of carrier head than in a perimeter region of the carrier head;

(b) making a groove in the carrier head around the perimeter of the carrier head;

(c) making a slot in the retainer ring that divides the retainer ring into an upper portion in contact with the carrier head and a lower portion that is a flexible leg having a receiving end that is adapted to receive an outer perimeter of a semiconductor wafer, the slot having a terminal end adjacent to the groove; and (d) securing a semiconductor wafer against the carrier head such that the receiving end of the flexible leg grips semiconductor wafer and can move the outer perimeter of the semiconductor wafer to compensate for the uneven force distribution of the chemical mechanical planarization apparatus.

* * * * *